United States Patent [19]

Leloux

[11] 3,952,866

[45] Apr. 27, 1976

[54] DEVICE FOR DIRECTING STRIPS OF THERMOPLASTIC MATERIAL

[75] Inventor: Arnoldus Willem Jan Leloux, Dedemsvaart, Netherlands

[73] Assignee: Industriele Onderneming Wavin N.V., Zwolle, Netherlands

[22] Filed: Dec. 17, 1973

[21] Appl. No.: 425,544

Related U.S. Application Data

[63] Continuation of Ser. No. 176,349, Sept. 8, 1971, abandoned.

[30] Foreign Application Priority Data

Sept. 8, 1970 Netherlands ..... 7013280

[52] U.S. Cl. ..... 198/262; 198/283; 271/227; 271/236; 226/18

[51] Int. Cl.[2] ..... B65G 47/24

[58] Field of Search ..... 198/33 R, 29, 262, 283; 271/58, 59, 52, 48, 13, 15, 17, 227, 236; 226/18, 19, 20, 21, 22, 23

[56] References Cited

UNITED STATES PATENTS

| | | | |
|---|---|---|---|
| 2,553,473 | 5/1951 | Reimel | 271/59 X |
| 3,147,898 | 9/1964 | Huck | 226/21 X |
| 3,603,446 | 9/1971 | Maxey | 198/33 AB |

FOREIGN PATENTS OR APPLICATIONS

| | | | |
|---|---|---|---|
| 644,453 | 7/1962 | Canada | 226/20 |

*Primary Examiner*—Evon C. Blunk
*Assistant Examiner*—Douglas D. Watts
*Attorney, Agent, or Firm*—Holman & Stern

[57] ABSTRACT

A device for directing strips of thermoplastic material which is provided with a first roller and first movable needles or photo electric cells, for correcting the position of the strip in a longitudinal direction in which the first roller and the first needles or cells are driven at the same rate, and second movable needles or photocells and a second roller for correcting the position of the foil in a transverse direction with, the second movable needles or cells and second roller being driven at the same rate.

6 Claims, 3 Drawing Figures

INVENTOR

BY

INVENTOR

BY

ATTORNEY

DEVICE FOR DIRECTING STRIPS OF THERMOPLASTIC MATERIAL

This is a continuation of application Ser. No. 176,349, filed Sept. 8, 1971, now abandoned.

BACKGROUND OF THE INVENTION

My invention relates to a device for directing strips of thermoplastic material, particularly cut pieces of plastic foil like foil pieces destined for manufacturing block bags and, which pieces are supplied to a sealing machine.

On treating all kind of material strips, including pieces of tubular plastic foil, it occurs sometimes that these strips, after having received treatment in the process, are transferred to a conveyor system in order to be moved to the location of a next phase of treatment. Particularly, in placing the material on the conveyor system, it is not always possible to maintain the correct position of the strips.

SUMMARY OF THE INVENTION

It is an object of the invention to provide a device for such situations, whereby the strips of material on being conveyed can be directed, so that they assume the correct position for the next phase of treatment. There would be hardly any problem when the material is rather rigid, like e.g. metal plates, or card board sheets, but difficulties are encountered when the material treated has only a very limited rigidity, similar to the aformentioned plastic foil.

The invention is characterized by a conveyor system consisting of three sections:

a. feed from the preceding treatment phase of the strips (e.g. cutting);

b. a section without transport but with arrangements for correcting the position of the strips with respect to the main direction of transport;

c. transfer to the next phase of treatment (e.g. heatsealing), the sections *a* and *c* comprising conveying means, like endless belts or rollers and section *b*) comprising movable means for determining the position of the strips, which means act upon at least one driving roller, operating in the main direction of transport, with an individual drive for correcting the angular position of the strip of material, and further acting upon at least one driving roller, operating in a transverse direction with respect to the main direction of transport, with individual drive for correcting the location of the strip of material, the angular position of which has been corrected, in the aforementioned transverse direction. Such a system lends itself to achieving the correct placement of the article to be treated when there is question of materials with a limited rigidity.

It is possible to establish once by the means provided for that purpose, the position of an arriving strip, and then control signals are effected to achieve the required correction. More dependable and from the constructive angle also simpler is a system preferred according to the invention. This preferred embodiment complicates in that the drives for the rollers, by which the corrections are made, continue to operate until the means for determining the position of the supplied strips establish that the correct angular position, the position in the transverse direction, respectively has been assumed in fact.

SUMMARY OF THE DRAWINGS

The invention is hereinafter clarified with reference to the accompanying drawings in which an embodiment is represented.

FIG. 1 shows diagrammatically a survey, represented as a plan, of the conveying and directing system to the invention.

DESCRIPTION OF A PREFERRED EMBODIMENT

Figure 7:
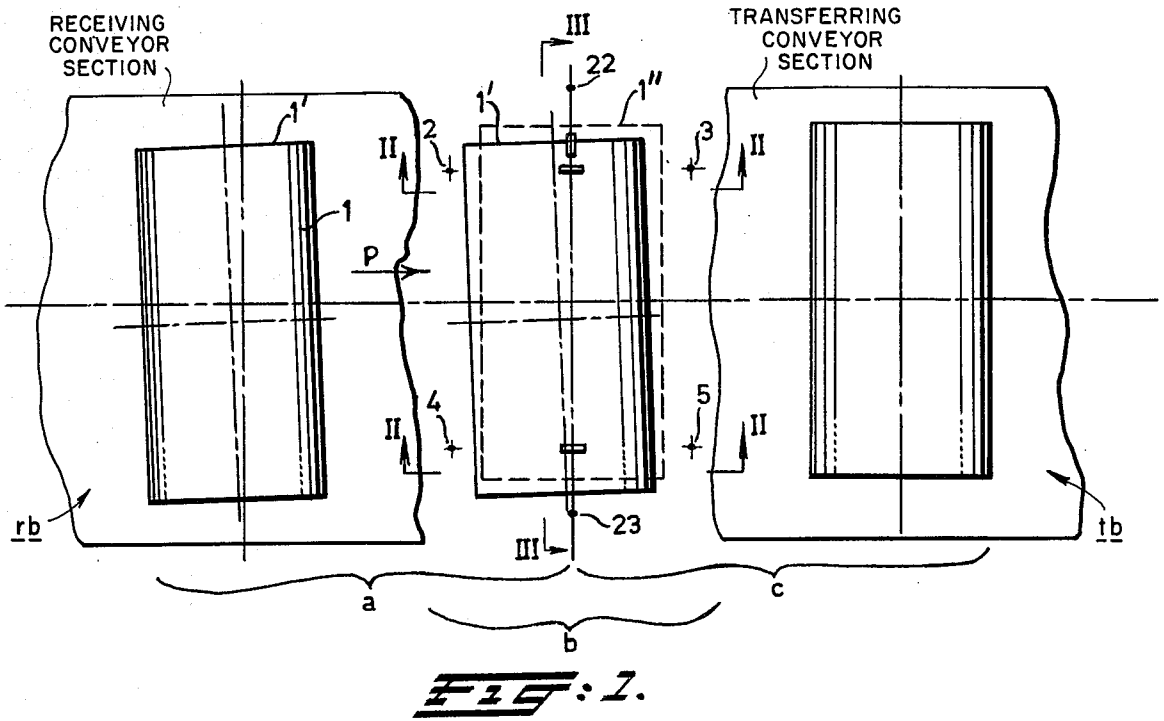

The system according to the invention comprises in the first place a section *a* in which a strip 1 of material is supplied, e.g. from a cutting machine, and simply conveyed in the main direction, indicated by the arrow P.A. section *b* adjoins the section *a* and in this section *b* the directing operation is carried out in a way to be described hereinafter and finally there is a section *c* in which in the same main direction of transport the strips are again moved on, so that they can enter the device in which the next phase of treatment is carried out, e.g. heatsealing.

In this embodiment, the section *a* comprises a conveyor system which releases the strip 1 as soon as it has reached the positioning station *b*. The section *c* comprises an analogous conveyor mechanism which during the positioning in section *b* does not act upon the strip of material and which subsequently grips the strip and removes same from the station *b*.

Such conveyor systems which may comprise sets of endless belts rb and tb respectively which are known per se and are therefore not illustrated in detail in the drawing.

Figure 2:
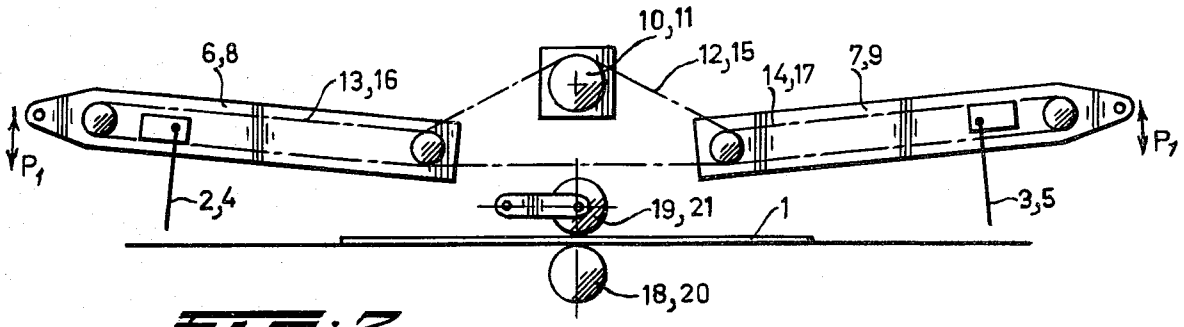
FIG. 2 shows sections according to the arrows II—II in FIG. 1.

In the depicted embodiment, the station *b* comprises in the first place means for correcting the angular position of the bag. These means comprise on the one hand a pair of needles 2, 3 which with respect to the main direction of the conveyor system are situated one behind the other and on the other hand an analogous pair of needles 4, 5. The needles 2 – 5 can be moved up and down as a whole between a low position in the plane of conveyance in which they can function as feelers and a high position in which the strip can be displaced. For that purpose they are provided on arms 6, 7, 8, 9 which can turn on horizontal shafts, as indicated by the arrows $P_1$ (FIG. 2).

The mechanisms denoted by 6, 7, 8, 9 respectively of each of the needles contain electrical signal means reacting as soon as a force is exerted on a needle by a strip of material. The needle mechanisms are symmetrically movable with respect to the center of the positioning station *b* along their arms 6, 7, 8, 9 respectively. They are pairwise driven by a synchronous motor 10, 11 respectively e.g. by means of ropes or chains 12, 13, 14 and 15, 16, 17 respectively.

Centrally in the line between the pair of needles 2, 3 is provided a roller 18 under the plane of the strip of material, with this roller is driven by a motor (not shown) and effective in the direction parallel to the main direction of transport P. Above the plane of the strip 1 is arranged an associated presser roller 19. In a corresponding way, a driving roller 20 with a presser roller 21 is arranged halfway of the line between the needles 4 and 5. The pairs of rollers travel along in the cyclic system with needles in such a way that in a vertical direction they are moved towards each other and cooperate with the strip of material only for the time that same is at that location.

The pairs of feelers are initially at a distance from each other which is greater than the dimensions of the strip of material in the direction P. When a strip is arrested in the station *b*, the needles are moved downwards and the motors 10, 11 are activated so that on the one hand the needles 2, 3 and on the other hand the needles 4, 5 move towards each other. When the strip is supplied in a skew position as at 1', the needles 2 and 5 will first make contact. The switch of needle 2 sets the correction roller 18 into motion which ensures a movement of the strip at the same rate as the needle 2 and in the same direction. As soon as the needle 3 makes contact the correction roller 18 is again switched off and the same is true of the motor 10, so that also the needles 2 and 3 are arrested. Assuming the same skew starting position 1', the needle 5 on the other side ensures that the correction mechanism 20, 21 is switched on and subsequently the needle 4 ensures that the correction mechanism is switched off. As a consequence of the symmetry in the parts, the final result is therefore a position of the strip 1' corrected as to its angular position.

Figure 3:
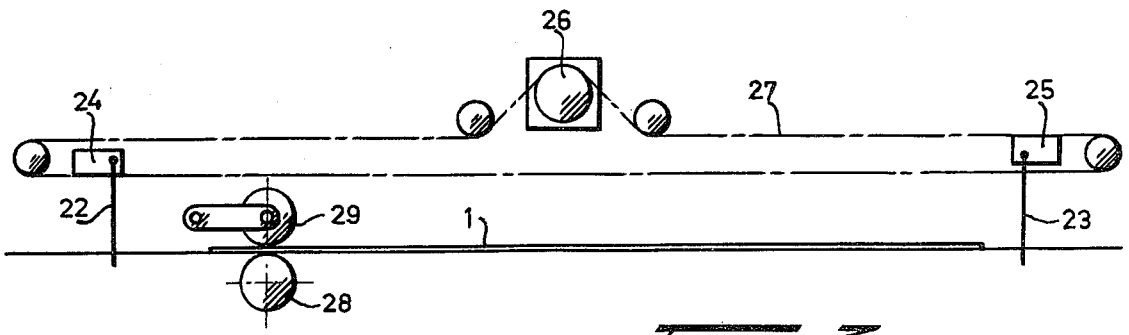
FIG. 3 shows in the same diagrammatical way a section according to the arrows III—III in FIG. 1.

After the detailed description of the mechanism according to the invention for correcting the angular position of the strip 1 of material, which as a consequence resulted in a position which as seen in the direction of transport is symmetrical with respect to the center of the positioning station *b*, the effect of the mechanism depicted in FIG. 3, destined to obtain also in a transverse direction a symmetrical position with respect to the center of the positioning station, will be clarified by means of a short description.

On either side beside the web of the supplied strip of material are a pair of needles, 22, 23. These needles the switching mechanism of which is diagrammatically denoted by 24, 25 respectively need not be movable up and down, because they are always outside the plane of conveyance of the strip of material. These needles 22, 23 too, obtain by means of a synchronous motor 26 and a chain or rope 27 a symmetrical movement from the outside inwards. In order to simplify the device, it may be provided for that the supplied strip of material 1' with certainty is in an asymmetrical position with respect to the conveyor belts; in FIG. 1 it is assumed that the strip of material 1' in all cases is closed to the needle 23. After correcting the angular position on the way described hereinbefore, the motor 26 is activated, so that at a particular moment the needle 23 contacts the foil. As a result, the other synchronous motor of a driving roller 28 (not shown), again with associated presser roller 29, is activated, which ensures a movement of the strip of material in the direction of the other needle 22, and again at the same rate at which the needle 23 moves inwards. Due to contact of the needle 22 with the strip 1 of material both the movement of the correction roller 28 and the movement of the needles 22 and 23 are arrested.

After this treatment, the strip of material has assumed a position indicated by 1'' in FIG. 1 and, in this position the strip comes to lie, both in the direction of transport and in the transverse direction symmetrically with respect to the center of the positioning station as defined by the intersection of the lines of symmetry of the movement of the various pairs of needles.

Thereupon, the conveyor mechanism of the section *c* is caused to cooperate with the positioned strip of material, while evidently it should be provided for that the transport in section *c* is effected in a uniform way, but this can be realized by means known to a person skilled in the art.

It will be evident that in the device according to the invention, the means for determining the position are moved together with the foil and said means and the rollers for correcting the position of the foil are driven with the same velocity.

In the embodiment described and represented, the means for determining the position in which the strip of material is fed are constructed as needles which in some way can respond to a compressive force. It is obvious that within the scope of the invention other ways may be applied to determine the position, like e.g. photo-electric cells, needles which on exerting their force act upon an air valve or the like.

What I claim is:

1. A device for directing strips of translucent thermoplastic material, particularly cut pieces of thermoplastic foil for producing bags in which each piece has front, rear and side edges and the pieces are adapted to be supplied to a sealing means, including a conveyor section receiving cut pieces, a positioning section downstream of the conveyor section and in which the position of the strips is corrected with respect to the main direction of movement, and a second conveyor section downstream of the positioning section for transferring the cut pieces to the sealing means, said positioning section comprising two pairs of needles located in the path of movement of the cut pieces, the needles of each pair being located one behind the other viewed in the main direction of conveyance and being at equal distances at both sides of the center of the positioning section, said needles being capable of movement toward and away from each other, means mounting the needles of each pair for upward and downward movement, a driven roller located below the plane of movement of the cut pieces in line with each pair of needles, a separate drive operably related to the needles of each pair for moving the needles relative to each other and for driving the driven roller associated with such pair, the needles of each pair having switch means for activating and deactivating the drive, the arrangement being such that when a strip is arrested at the positioning section, the needles move downwardly and the drives activated for moving the needles of each pair toward each other, and if the piece is in a skew position, the needle of one pair adjacent the rear edge and the needle of the other pair adjacent the front edge will make contact with the piece whereby the driven roller will be rotated to move the piece at the same rate as said one needle and in the same direction, and upon the piece making contact with the other needle of said one pair, the switch means of said one pair deactivates the drive thus stopping the driven roller and arresting the movement of the needles of said one pair, and further means operably related to the side edges of the piece for correcting the position of the piece in a tranverse direction.

2. The device as claimed in claim 1 in which said further means includes a needle located adjacent each side of the positioning section, the needles being at equal distances at both sides of the center of the positioning section, means for moving the needles toward and away from each other, drive means operably connected to the needle moving means, and switch means for each needle controlling the drive means.

3. The device as claimed in claim 1 in which a presser roller is located above the plane of movement of the cut pieces and is cooperable with the driven roller there below for correcting the angular position of the piece.

4. The device as claimed in claim 2 including a driven roller located below the plane of movement of the cut pieces in line with the needles located adjacent each side of the positioning section driven by said drive for correcting the transverse position of the piece.

5. The device as claimed in claim 4 in which a presser roller is located above the plane of movement of the cut pieces and is cooperable with the driven roller for correcting the transverse position of the piece.

6. The device as claimed in claim 1 in which each pair of needles includes a drive effecting a symmetrical displacement of the needles of each pair.

* * * * *